US006948982B2

(12) United States Patent
Higuchi et al.

(10) Patent No.: US 6,948,982 B2
(45) Date of Patent: Sep. 27, 2005

(54) BATTERY FUSE-CONTAINING BOX

(75) Inventors: Eiji Higuchi, Yokkaichi (JP); Yoshihisa Shimada, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/614,867

(22) Filed: Jul. 9, 2003

(65) Prior Publication Data

US 2004/0115991 A1 Jun. 17, 2004

(30) Foreign Application Priority Data

Jul. 9, 2002 (JP) ..... 2002-200554

(51) Int. Cl.[7] ..... H01R 13/68
(52) U.S. Cl. ..... 439/621; 174/50
(58) Field of Search ..... 439/76.2, 949, 439/621, 755; 174/50

(56) References Cited

U.S. PATENT DOCUMENTS 5,011,417 A * 4/1991 Matsumoto et al. ..... 439/76.2
5,154,647 A * 10/1992 Ishitani et al. ..... 439/66
5,645,448 A 7/1997 Hill ..... 439/621
5,734,125 A * 3/1998 Yasukuni et al. ..... 174/52.2
5,882,213 A * 3/1999 Witek et al. ..... 439/76.2
6,126,458 A * 10/2000 Gregory et al. ..... 439/76.2
6,494,279 B1 * 12/2002 Hutchens ..... 180/68.5
6,576,838 B2 * 6/2003 Matsumura ..... 174/66
6,723,920 B2 * 4/2004 Higuchi et al. ..... 174/50

* cited by examiner

*Primary Examiner*—Briggitte R. Hammond
(74) *Attorney, Agent, or Firm*—Oliff & Berridge, PLC

(57) ABSTRACT

A fuse-containing box is formed by placing a battery fuse and a bus bar connected to a terminal of the battery fuse on a supporting plate and by mounting a lower case and an upper case on the supporting plate. The fuse-containing box is mounted on an upper surface of a battery. A battery terminal to be fixedly fitted on a battery post projecting from the upper surface of the battery is fastened to the bus bar to electrically connect the battery fuse and the battery to each other. The lower case and the upper case are formed from a polypropylene-based resin. The supporting plate on which the battery fuse and the bus bar are mounted is formed from a heat-resistant nylon-based resin.

14 Claims, 5 Drawing Sheets

BATTERY FUSE-CONTAINING BOX

BACKGROUND OF THE INVENTION

1. Field of Invention

The present invention relates to a fuse containing box. More particularly, the present invention is intended to prevent the fuse containing box from having heat loss due to heating of a battery fuse and a bus bar housed within the fuse containing box.

2. Description of Related Art

FIG. 6 shows a fuse to be connected to a battery of a vehicle. Battery terminal 3 is connected to an end of a lead wire 4 via a battery post 2 projecting from an upper surface of the battery 1. The lead wire 4 is wired to a fuse box 5, where the lead wire 4 connects to a fuse (not shown) inside the fuse box 5.

However, the distance between battery 1 and fuse box 5 has some problems. The fuse box 5 requires an installation space and the lead wire 4 is exposed to potential damage.

Where fuse box 5 houses a bus bar 7, the bus bar 7, connected to the terminal of the battery fuse, is placed on a supporting plate 8 made of a heat-resistant resin as shown in FIG. 7. A fixing claw 8*b* projects from the supporting plate 8 to fix the bus bar 7. A lower case 9 is mounted on the lower surface of the supporting plate 8. A cavity 8*a* is formed on the supporting plate and is closed with the lower case. Opposing inner surfaces 9*a* of lower case 9 are separated from bus bar 7 through the small gap of cavity 8*a*.

Since a fuse has a large calorific value, the bus bar 7 connected to the battery fuse overheats. As a result, opposing inner surfaces 9*a* of a lower case 9 also overheat.

Since a lower case made of a heat-resistant resinous material is expensive, the lower case 9 is made of resin not having sufficient heat resistance. Thus, the lower case 9 may melt or fuse due to the heat of the bus bar 7.

SUMMARY OF THE INVENTION

The present invention has been made to overcome the above-described problems. Accordingly, it is an object of the present invention to connect a fuse to a battery post without the intermediary element of a lead wire, to save space, improve reliability of the electric connection and prevent fusing of a lower case due to heat generated by a bus bar.

To achieve the object, according to the present invention, there is provided a fuse-containing box formed by placing a fuse and a bus bar connected to a terminal of the fuse on a supporting plate and by mounting a lower case and an upper case on the supporting plate.

The fuse containing box is mounted on an upper surface of a battery. A battery terminal connects to a battery post that projects from the upper surface of the battery in the usual manner. A bus bar connects to the battery terminal and battery to electrically connect the fuse and the battery to each other.

With this, the lower case and an upper case are made of a polypropylene-based resin. The supporting plate on which the fuse and the bus bar are mounted is made of a heat-resistant nylon-based resin.

Since the fuse box is divided into an upper case, a supporting plate, and a lower case, each can now be made of resin with desired characteristics. More specifically, the supporting plate that contacts the bus bar is made of a heat-resistant nylon-based resin, and the upper case and the lower case exposed to the outside are made of a chemical-resistant polypropylene.

A mixture of nylon 66 and PPE (polyphenylene ether) is preferably used for manufacturing the support plate.

It is preferable that the upper case is formed of a mixture of polypropylene and an elastic resin; whereas the lower case is formed of a mixture of polypropylene and talc.

With this, since the upper case and the lower case are formed of chemical-resistant polypropylene, it is possible to prevent liquid, which has leaked from a battery, from deteriorating the upper case and the lower case. The mixture of the polypropylene and the elastic resin is also capable of preventing the generation of vibration caused abnormal sounds.

Since the supporting plate is formed by molding the heat-resistant nylon-based resin, when an over-current temporarily flows through the bus bar, the bus bar is prevented from fusing to the support plate.

A locking piece is vertically formed on the supporting plate. The locking piece has an upper end where a bus bar fixing claw horizontally projects to clamp on to an upper surface of the bus bar. A cavity is formed by the bus bar fixing claw and the supporting plate located below the bus bar. A heat radiation opening communicating with the cavity is formed on the lower case.

In this construction, the heat of the bus bar can be released to the outside from the heat radiation opening. Therefore, the lower case is prevented from overheating and fusing.

The heat radiation opening is larger than the cavity so that the bus bar and the lower case do not confront each other.

With this, it is possible to prevent fusing of the periphery of the heat radiation opening formed on the lower case.

Since the fuse box is directly installed on the battery, it is unnecessary to provide the space elsewhere for the fuse box as with the conventional fuse box, thereby effectively utilizing limited space in a vehicle. There is also no need for a lead wire since the fuses inside the fuse containing box are electrically connected to the circular arc portion of the battery terminal and the battery post, thus improving the reliability of the electrical connection.

BRIEF DESCRIPTION OF THE DRAWINGS

The foregoing and other features of the present invention will become apparent with reference to the accompanying drawings, wherein.

DETAILED DESCRIPTION OF PREFERRED EMBODIMENTS

Figure 1:
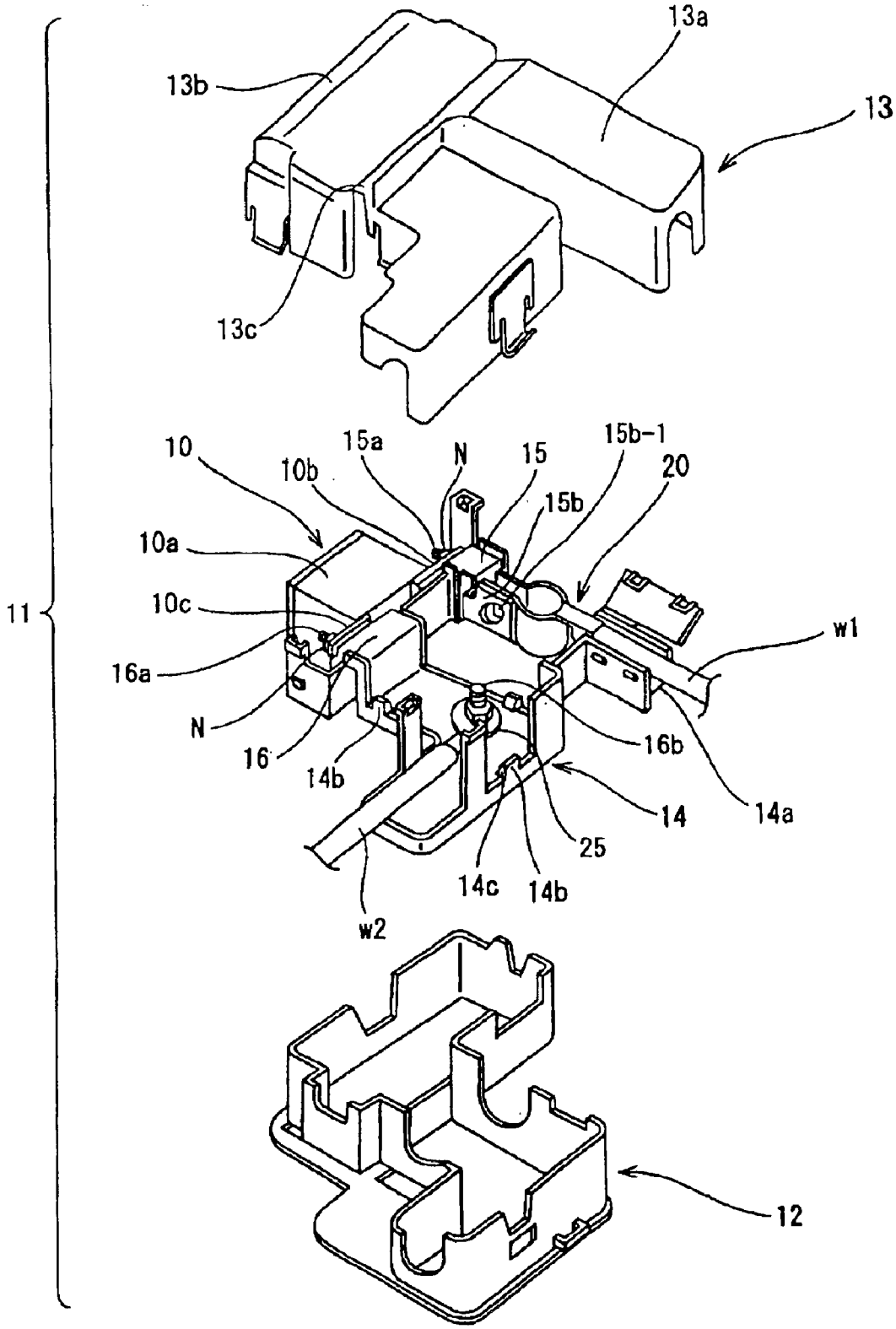
FIG. 1 is an exploded perspective view showing a fuse box according to an embodiment of the present invention.
Figure 2:
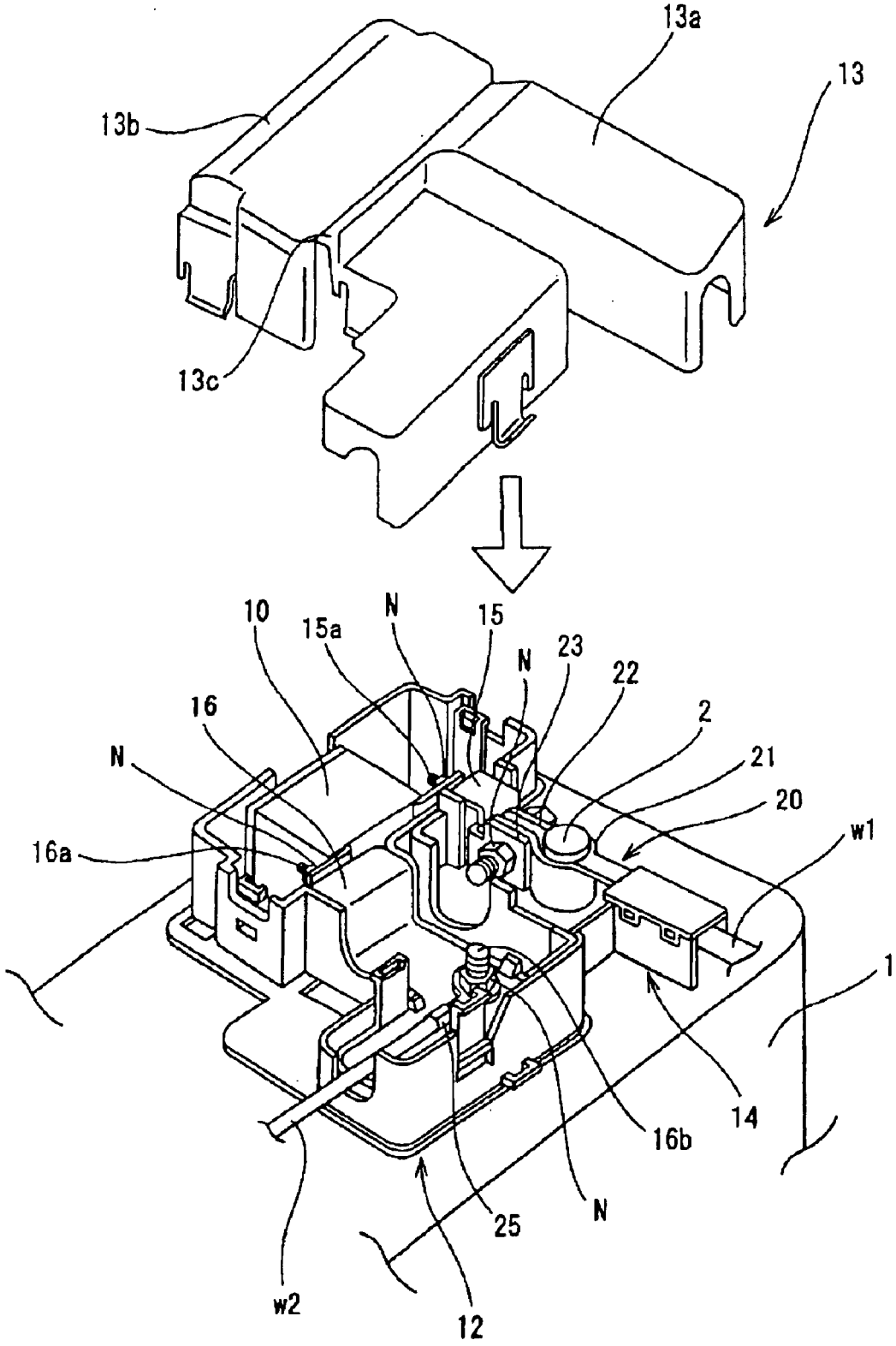
FIG. 2 is a perspective view showing a state in which the fuse box is fixed to a battery box.

FIGS. 1 through 5 show a preferred embodiment of the present invention In which A fuse box 11 is disposed on a battery 1 mounted in an engine compartment.

The fuse containing box 11 includes a lower case 12, an upper case 13, and a supporting plate 14 interposed therebetween. The supporting plate 14 serves as an intermediate case. That is, the case of the fuse box 11 is composed of three members.

A battery fuse 10 and an input-side bus bar 15 and output-side bus bar 16 both connected to a terminal of the battery fuse 10 are fixed to an upper surface of the supporting plate 14. The input-side bus bar 15 is fastened to a battery terminal 20 that is fixedly fitted on a battery post 2 to electrically connect the battery fuse 10 to a battery 1 without the intermediary element of a lead wire.

Since the battery fuse 10 has a high calorific value and the input-side bus bar 15 and the output-side bus bar 16 are both connected to the input and output terminals of the battery fuse 10 respectively, and placed directly on the upper surface of the supporting plate 14, the supporting plate 14 is made of a heat-resistant resin which is a mixture of nylon 66 and PPE (polyphenylene ether). To realize preferable heat radiation, the resin is used for only a portion of the supporting plate 14 necessary for accommodating battery fuse 10, input-side bus bar 15, and the output-side bus bar 16.

The lower case 12 is made of a resin which is a mixture of polypropylene and talc and the upper case 13 is made of a chemical-resistant synthetic resin which is a mixture of polypropylene and an elastic resin.

One end of the input-side bus bar 15 overlaps an input terminal 10*b* which projects horizontally from one side of a bottom surface of a body 10*a* of the battery fuse 10. One end of the output-side bus bar 16 overlaps an output terminal 10*c* which projects horizontally from the other side of the bottom surface of the body 10*a* of the battery fuse 10. Screw portions 15*a* and 16*a* project from the input-side bus bar 15 and the output-side bus bar 16 respectively and penetrate through a through-hole (not shown) of the input terminals 10*b* and a through-hole (not shown) of the output terminal 10*c* respectively and are fixed with a nut N. After the input-side bus bar 15 and the output-side bus bar 16 are accommodated in the supporting plate 14, the input-side bus bar 15 and the output-side bus bar 16 are respectively fastened to input terminal 10*b* and output terminal 10*c* of the battery fuse 10 via bolts.

The supporting plate 14 in which the battery fuse 10, the input-side bus bar 15, and the output-side bus bar 16 are fixedly accommodated is mounted on the lower case 12, and the upper case 13 is mounted on the lower case 12.

Figure 3A:
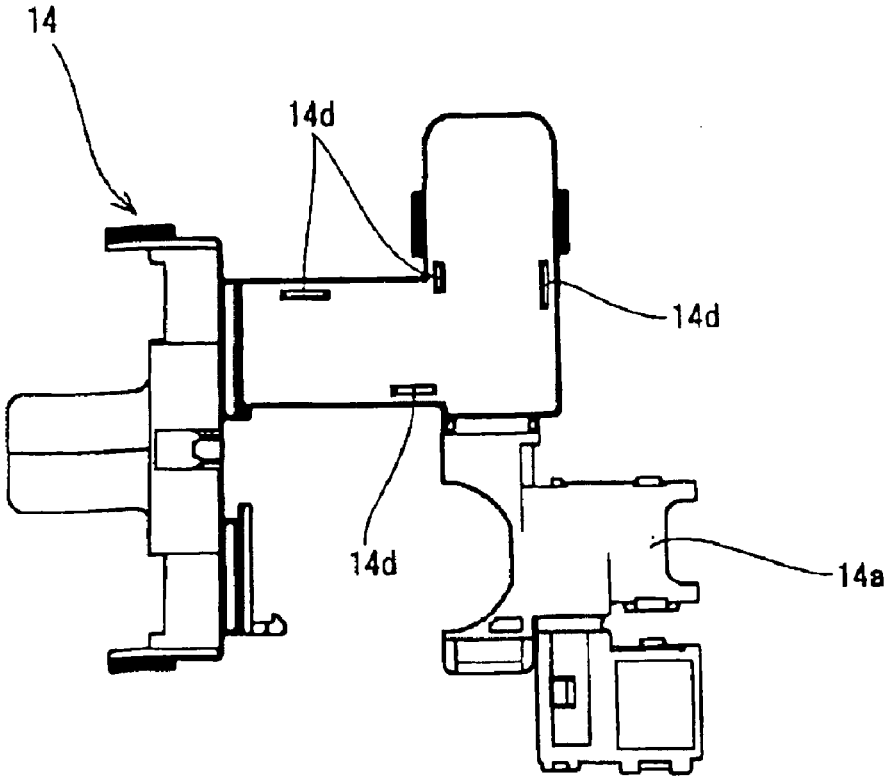
FIG. 3A is a rear view showing a supporting plate.

To lock the output-side bus bar 16 to the supporting plate 14, a locking piece 14*b* is vertically formed on the supporting plate 14, and a bus bar fixing claw 14*c* that is locked to the upper surface of the output-side bus bar 16 is horizontally formed on the upper end of the locking piece 14*b*. As shown in FIG. 3A, cavities 14*d* used when a material for the bus bar fixing claw 14*c* is molded are formed on the supporting plate 14 at positions thereof below the output-side bus bar 16.

Since the input-side bus bar 15 is fixed to the battery terminal, fixing claw 14*c* is not formed on the supporting plate 14 where the input-side bus bar 15 is housed.

Figure 3B:
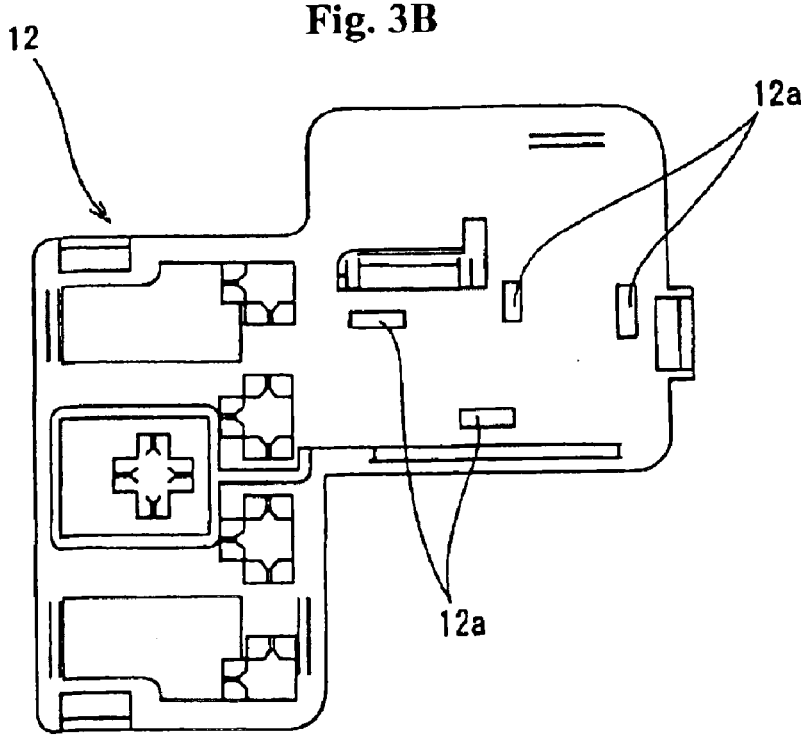
FIG. 3B is a rear view showing a lower case.
Figure 4:
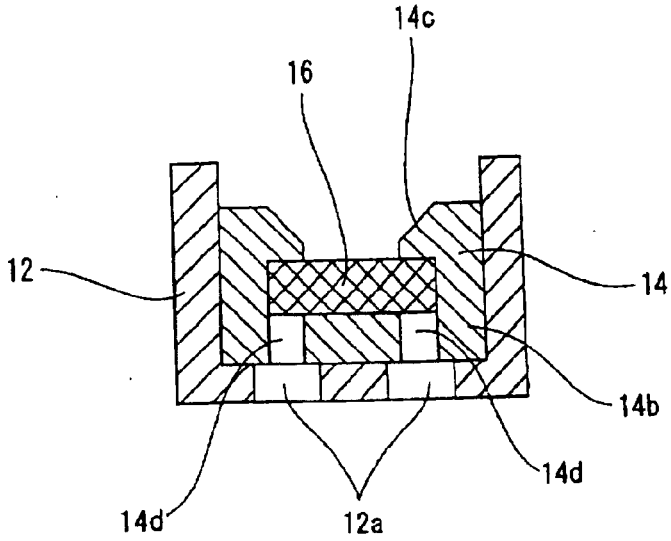
FIG. 4 is a sectional view showing the fuse box by enlarging main parts thereof.

As shown in FIG. 3B, a heat radiation opening 12*a* is formed on the lower case 12. FIG. 4 shows supporting plate 14 mounted on lower case 12 with cavity 14*d* and a heat radiation opening 12*a* communicating with each other. Heat radiation opening 12*a* is formed a little larger than the cavity 14*d* so that the distance between the periphery of heat radiation opening 12*a* and the periphery of cavity 14*d* is preferably about 0.5 mm. That is, cavity 14*d* should be at least about 1.0 mm wider than opening 12*a* so that both sides are spaced by about at least 0.5 mm from opening 12*a*.

Upper case 13 has a first half which serves as an opening/closing lid 13*a*. Upper case 13 has a second half 13*b* that locks to lower case 12. A hinge 13*c* is interposed between the opening/closing lid 13*a* and the second half 13*b* to open and close the opening/closing lid 13*a*.

The battery terminal 20 has a projected circular-arc portion 21 which is crimped to the tip of an electric wire w1 of a power circuit and also fits on the periphery of the battery post 2. Circular-arc portion 21 has fastening pieces 22 and 23 that project from the tips of the circular-arc portion 21 at opposite sides. A bolt opening (not shown) is formed on each of the fastening pieces 22 and 23.

Figure 5:
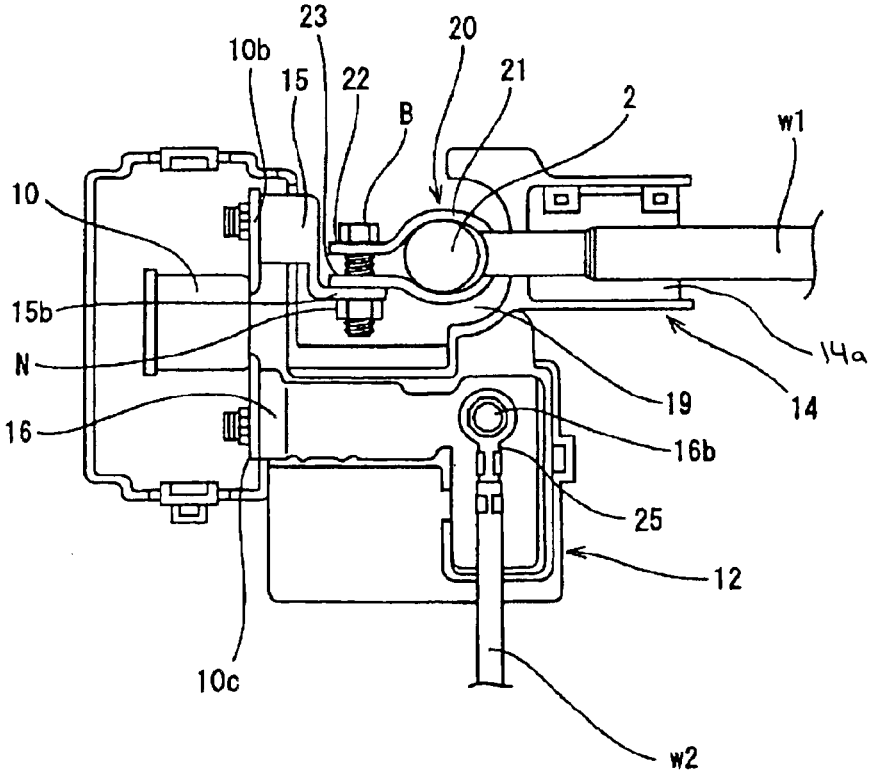
FIG. 5 is a plan view showing the fuse box.
Figure 6:
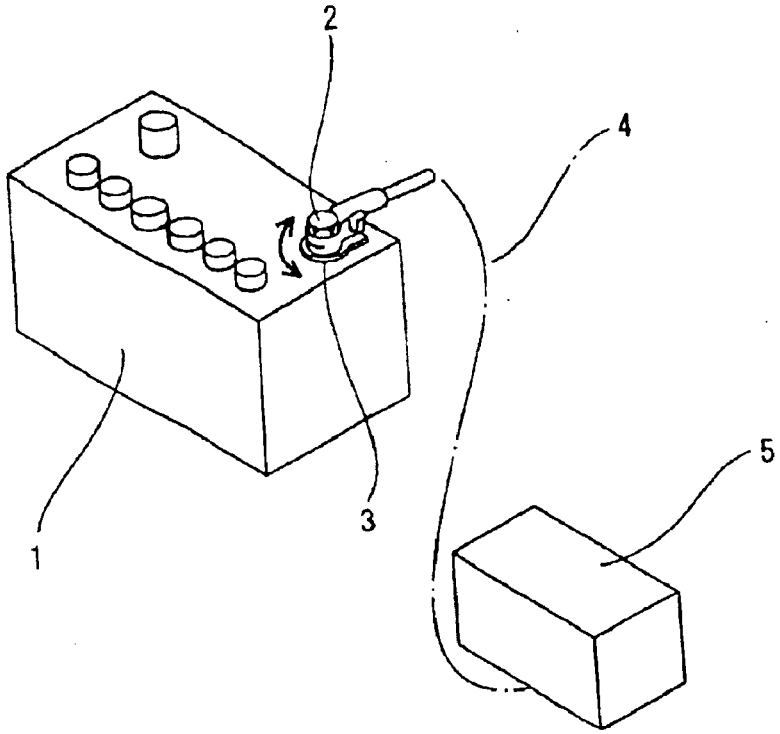
Fig. 6 RELATED ART
FIG. 6 shows a conventional art.
Figure 7:
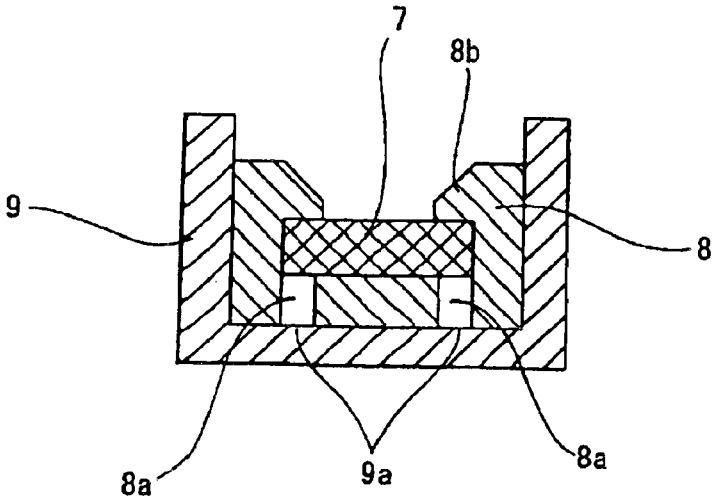
Fig. 7 RELATED ART
FIG. 7 shows the problem of the conventional art.

As shown in FIG. 5, the electric wire w1 is accommodated in an electric wire accommodation portion 14*a* of the supporting plate 14. An opening 19 is formed on the supporting plate 14 and the lower case 12 at a position corresponding to the position of the circular-arc portion 21, of the battery terminal 20, so as to be exposed to the outside.

The other end portion of the input-side bus bar 15 is extended to a position where the other end portion overlaps the side of the fastening piece 23 to form a connection piece 15*b* through which a bolt opening 15*b*-1 communicating with the bolt opening (not shown) of the fastening pieces 22 and 23 is formed.

A screw portion 16*b* projects upward from the upper surface of the output-side bus bar 16 at an intermediate position of the other side thereof. Thereby a terminal 25 disposed at one end of an electric wire w2 is fastened with nut N and an opposing end of electric wire w2 is connected to a relay box (not shown).

The method of fixing the fuse containing box 11 to the battery 1 is described below.

Initially, the circular arc portion 21 of the battery terminal 20 is fitted on the periphery of the battery post 2 of the battery 1. With the bolt openings (not shown) of the fastening pieces 22, 23 and the bolt opening 15*b*-1 of the connection piece 15*b*, bolt B is inserted through the bolt openings and clamped with the nut N. Thereby, the circular arc portion 21 is rigidly fit on the periphery of the battery post 2. In this operation, the battery 1 and the battery fuse 10 are electrically connected to each other, and the fuse containing box 11 is rigidly fixed to the battery 1. Then the opening/closing lid 13*a* of the upper case 13 is closed to lock the upper case 13 to the lower case 12.

With this, lower case 12 has heat radiation openings 12*a* that communicate with cavities 14*d*. Therefore, the output-side bus bar 16 and the lower case 12 are separated from each other by cavity 14*d*. Accordingly, the heat of the output-side bus bar 16 is not readily transmitted to the lower case 12, but instead passes through cavities 14*d* and released to the outside via heat radiation openings 12*a*. Thus, it is possible to prevent the lower case 12 from overheating and from fusing.

Since the fuse box is directly installed on the battery box space is saved inside the vehicle. Further, the battery fuse 10 and the battery post 2 are directly connected to each other through the battery terminal. Thus, it is possible to improve reliability on the electric connection.

What is claimed is:

1. A fuse containing box for directly connecting to and mounting on a battery, the fuse containing box comprising:

an upper case and a lower case, each made of a polypropylene-based resin; and a supporting plate housed between the upper case and the lower case and made of a heat-resistant nylon-based resin, the supporting plate including a battery fuse, and a bus bar connected to a terminal of the battery fuse, wherein the supporting plate has a locking piece vertically formed on the supporting plate, the locking piece having at an upper end a bus bar fixing claw that horizontally projects to lock the bus bar in place, wherein the upper case and the lower case mate with each other to together form a chamber in which the supporting plate is disposed so as to enclose the supporting plate within the chamber.

2. The fuse containing box according to claim 1, wherein the resin of the supporting plate is formed from a mixture of nylon 66 and polyphenylene ether (PPE).

3. The fuse containing box according to claim 1, wherein the upper case is formed from a mixture of polypropylene and an elastic resin; and the lower case is a mixture of polypropylene and talc.

4. The fuse containing box according to claim 1, wherein a supporting plate cavity is formed between the bus bar fixing claw and the lower case.

5. The fuse containing box according to claim 4, wherein the lower case has a heat radiation opening that is in communication with the supporting plate cavity.

6. The fuse containing box according to claim 5, wherein the heat radiation opening is larger than the supporting plate cavity.

7. The fuse containing box according to claim 6, wherein a distance from a periphery of the opening to sides of the cavity is at least 0.5 mm.

8. A fuse containing box for directly connecting to and mounting on a battery, the fuse containing box comprising:

an upper case and a lower case, each made of a polypropylene-based resin;

a supporting plate housed between the upper case and the lower case and made of a heat-resistant nylon-based resin, the supporting plate including a battery fuse, and a bus bar connected to a terminal of the battery fuse, wherein the supporting plate has a locking piece vertically formed on the supporting plate, the locking piece having at an upper end a bus bar fixing claw that horizontally projects to lock the bus bar in place.

9. The fuse containing box according to claim 8, wherein the resin of the supporting plate is formed from a mixture of nylon 66 and polyphenylene ether (PPE).

10. The fuse containing box according to claim 8, wherein the upper case is formed from a mixture of polypropylene and an elastic resin; and the lower case is formed from a mixture of polypropylene and talc.

11. The fuse containing box according to claim 8, wherein a supporting plate cavity is formed between the bus bar fixing claw and the lower case.

12. The fuse containing box according to claim 11, wherein the lower case has a heat radiation opening that is in communication with the supporting plate cavity.

13. The fuse containing box according to claim 12, wherein the heat radiation opening is larger than the supporting plate cavity.

14. The fuse containing box according to claim 13, wherein a distance from a periphery of the opening to sides of the cavity is at least 0.5 mm.

* * * * *